US005961131A

United States Patent [19]

Hilgarth

[11] Patent Number: 5,961,131

[45] Date of Patent: Oct. 5, 1999

[54] SHOCK ABSORBER DEVICE FOR ROLLER SKATES

[75] Inventor: Kurt Hilgarth, Graz-Sciersberg, Austria

[73] Assignee: Fancyform Design Engineering, Graz-Grambach, Austria

[21] Appl. No.: 08/831,055

[22] Filed: Apr. 1, 1997

[30] Foreign Application Priority Data

| | | | |
|---|---|---|---|
| Apr. 1, 1996 | [AT] | Austria | 183/96 U |
| Sep. 20, 1996 | [IT] | Italy | UD96A0177 |
| Dec. 20, 1996 | [IT] | Italy | UD96A0245 |

[51] Int. Cl.[6] ..... A63C 17/00

[52] U.S. Cl. ..... 280/11.22; 280/11.28

[58] Field of Search ..... 280/11.19, 11.22, 280/11.23, 11.27, 11.28, 87.041, 87.042

[56] References Cited

U.S. PATENT DOCUMENTS

| | | | |
|---|---|---|---|
| 3,774,924 | 11/1973 | Machatsch | 280/11.28 |
| 4,152,001 | 5/1979 | Christianson | 280/11.28 |
| 4,708,352 | 11/1987 | Vullierme | 280/11.26 |
| 4,993,725 | 2/1991 | Barnes et al. | 280/11.14 |
| 5,503,413 | 4/1996 | Belogour | 280/11.22 |

FOREIGN PATENT DOCUMENTS

| | | |
|---|---|---|
| 0 192 312 | 8/1986 | European Pat. Off. . |
| 2659534 | 9/1991 | France . |
| 2701431 | 8/1994 | France . |
| 488740 | 12/1929 | Germany . |
| WO93/14840 | 8/1993 | WIPO . |

*Primary Examiner*—Richard M. Camby
*Attorney, Agent, or Firm*—Jacobson, Price, Holman & Stern, PPLC

[57] ABSTRACT

Shock absorber device for roller skates, particularly but not exclusively of the type with aligned wheels, the skates including the body of the shoe (11) wherein the foot and part of the user's leg fit, the shoe (11) being connected to a support (12) on which are mounted the elements (13) which run on the ground, the connection between the shoe (11) and the support (12) being of the articulated type (14), the device comprising an elastic foil element (21,121,221,321) shaped with at least an inverted angle and associated, at least at the ends, respectively with the shoe (11) and the support (12) at a point at a distance from the articulated connection (14).

15 Claims, 2 Drawing Sheets

SHOCK ABSORBER DEVICE FOR ROLLER SKATES

This invention concerns a shock absorber device for roller skates as set forth in the main claim.

The invention is applied to roller skates, particularly to those of the type with aligned wheels, in order to absorb the vibrations and impacts transmitted by the ground to the shoe, and also to attenuate the jolts caused by unevenness in the ground.

The state of the art covers roller skates which have their wheels arranged in a line along a single longitudinal plane.

In the state of the art, there are two types of skates, those with a rigid shoe where the support is attached solidly to the sole with traditional systems such as screws, rivets or other means, and also those with a semi-rigid shoe where the support is associated with an understructure able to house and hold the semi-rigid shoe.

In both cases, the rigid connection between the support and the shoe has a negative effect on the transmission of the stresses from the skating elements to the shoe and from the shoe to the user, thus rendering the skating less comfortable and smooth.

This problem is particularly felt by users especially when the activity takes place off the road or where the ground is uneven, which puts stress on the ankle or more generally the legs of the skater and inhibits the thrusting action of the same.

In order to overcome this shortcoming, various shock absorber systems have been studied, but they have proved to be of limited efficacity and/or considerably limited in operation.

For example, shock absorber systems are known which are based on the use of inserts made of elastic material or of helicoid springs placed in direct cooperation with the axes of the wheels.

These systems do not ensure a complete and efficient absorption because they are only able to efficiently absorb the substantially continuous vibrations caused by friction with the ground.

However these systems are not able to attenuate the unexpected jerks caused by sudden unevenness or obstacles in the ground.

The state of the art also covers shock absorber systems which associate the axes of the wheels with the sole of the rigid shoe or its understructure by means of arm extensions, foil extensions or similar, made of a single body with, or associated with, the rigid shoe or its understructure.

U.S. Pat. No. 4,708,352, for example, includes a skate with two platforms, one of which is telescopically extendable with respect to the other so as to adapt to the length of the user's shoe.

These platforms are made of plastic material and each of them includes flexible elastic foils, angled towards the centre of the skate; a first foil is associated with the axis of the front or rear wheel, and the other foils cooperate with the first foil and with the means associating them to the axis by the appropriate attachment means.

This shock absorber system however acts on the individual wheels, or on pairs of wheels arranged parallel, but, like other known systems, it does not provide a shock absorbing system for the whole support in such a way as to allow the skater to exploit the thrusting movements he makes to the utmost.

Furthermore, this system offers, only one degree of shock absorption, it cannot be adapted to the different types of ground and/or the individual user's requirements; moreover, in the event of wear or breakage, the user is obliged to replace at least one of the two aforesaid platforms.

A further disadvantage of the shock absorber systems known to the state of the art is that they are unable to maintain a correct alignment between the support for the skating means and the shoe itself.

These systems are not able to efficiently absorb the torsions to which this support is subject as a result of impact with obstacles and/or because of the movements imparted to the shoe by the skater, which causes a considerable loss of thrust and energy as well as a danger for the stability and safety of the user himself.

Moreover, shock absorber systems known to the state of the art are expensive, they are not easily adjustable according to the terrain and/or the user's requirements, they are subject to premature wear, breakages or malfunctions, they are difficult to replace and need frequent periodic maintenance.

The present applicants have designed, tested and embodied this invention to overcome the shortcomings of the state of the art, and to achieve further advantages.

The invention is set forth and characterised in the main claim, while the dependent claims describe variants of the idea of the main embodiment.

The purpose of the invention is to provide a shock absorber device for roller skates, and particularly for those with aligned wheels, which is able to guarantee a product which is simple, functional and inexpensive, and also extremely safe for the user.

A further purpose is to provide a shock absorber device able to efficiently absorb and attenuate the vibrations and jolts caused by uneven ground and to absorb the anomolous stresses acting on the skate such as for example movements of extreme torsion imparted by the user.

Another purpose of the invention is to allow the user to adapt the type and/or the degree of shock absorption according to his own requirements and/or the type of terrain.

Yet another purpose is to provide a device which does not require frequent maintenance, can easily be replaced and is not subject to wear, breakages or malfunctions.

The invention is applied to skates where the support for the skating elements is connected to a rigid shoe or understructure at a defined point of attachment, in such a way that the rigid shoe, or understructure, is articulated with respect to the support.

According to the invention, the shock absorber device comprises at least an elastic foil element which associates the support to the rigid shoe, or the understructure, at one or at several points far from the aforesaid attachment and articulation point.

The elastic foil also functions as a guide element for the articulated connection in such a way as to maintain the support constantly in correct alignment with the shoe.

According to a variant, in cooperation with the elastic foil there is at least a further guide element suitable both to control the oscillatory movements of the support and also to assist the foil itself during the skating activity.

The elastic foil device according to the invention enables the shoe to oscillate in a controlled manner around the aforesaid attachment point both in response to the stresses of the ground and also the movements of the user's foot and/or leg.

The controlled oscillation is such that the shoe moves always on the same vertical surface and the possible movements of transverse torsion are substantially prevented.

In the preferred embodiment of the invention, the aforesaid attachment point is included in the forward portion of the sole of the rigid shoe or the understructure and the elastic foil is included in the rear portion of the skate.

In one embodiment of the invention, the elastic foil is shaped with an acute angle and comprises two sections, an upper and a lower section, cooperating respectively with the shoe and with the support and connected to each other by a bent section defining an inverted angle.

Each of these sections, upper and lower, includes at the ends association means respectively with the support and with the sole of the rigid shoe or the lower part of the understructure.

According to a variant, at least the lower portion of the elastic foil is arched in such a way as to increase its bending ability.

According to another variant, the upper section of the elastic foil is arched too.

According to another solution, the elastic foil has two or more inverted angles which connect the upper and lower sections at least to an intermediate section.

The elastic foil device according to the invention makes it possible to vary the angle formed between the sole of the shoe or between the lower part of the understructure.

This adjustment is carried out to modify the skating characteristics of the skate according to the user's requirements, the user's body weight, the height of the centre of gravity, the style of skating, the type of terrain, etc.

This variation in the angle is made possible by modifying the position of the attachment point of the aforesaid association means of the elastic foil at least at the support for the skating elements.

The elastic foil may be of the type which can be replaced by other foils having a different shock absorbing capability, elasticity index, angle of bend, construction material or other.

According to one possible embodiment of the invention, the elastic foil is made of metal, such as steel for example.

According to a variant, the elastic foil is made of nonmetallic materials or mixed materials.

According to a further variant, the elastic foil includes reinforcing means such as ribs for example.

The attached figures are given as a non-restrictive example and show some preferred embodiments of the invention as follows.

Figure 1:
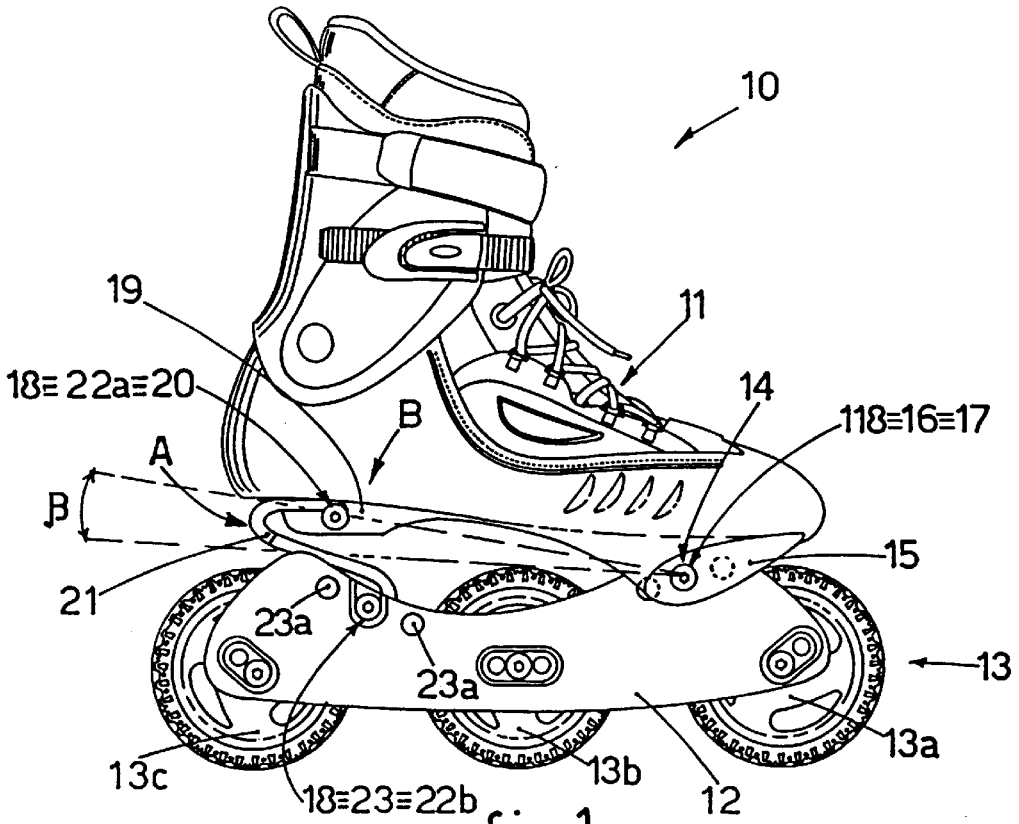
FIG. 1 shows a skate of the type with aligned wheels using the shock absorber device according to the invention.
Figure 4A:
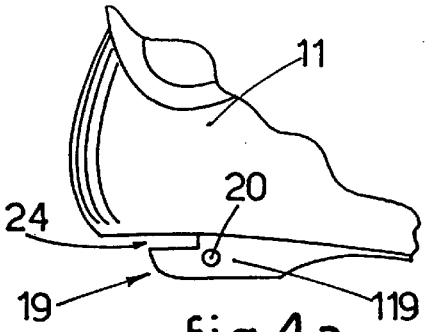
Figure 5A:
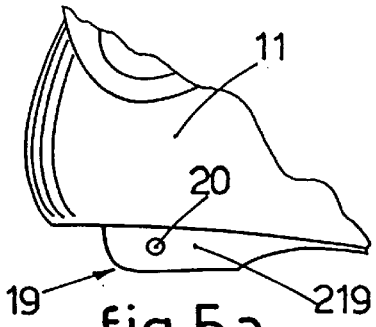
Figure 4B:
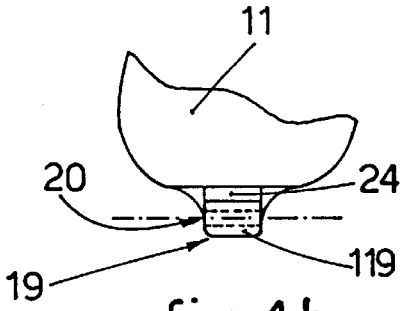

FIG. 4*a* shows a part view of the enlarged detail B from FIG. 1;

FIG. 4*b* shows the detail B from FIG. 4*a* with a rear view of the skate shown in FIG. 1;

FIG. 5*a* shows a variant of FIG. 4*a;*

Figure 2:
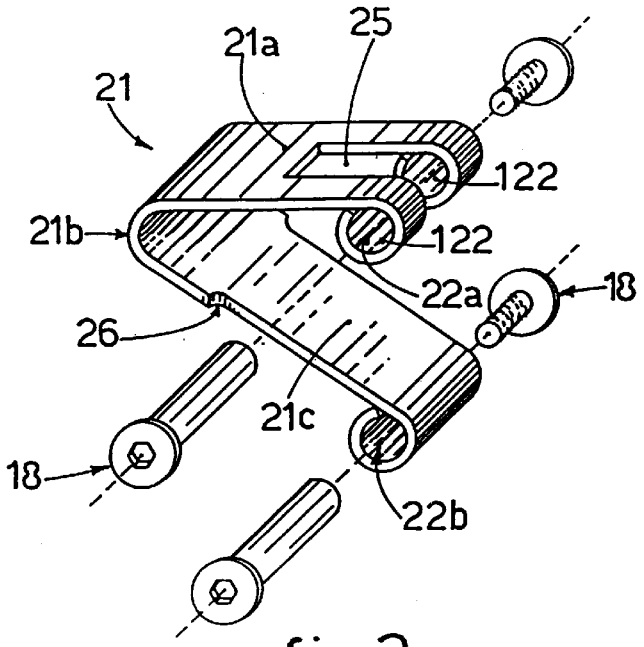
FIG. 2 shows a three dimensional and exploded view of the enlarged detail A from FIG. 1.
Figure 5B:
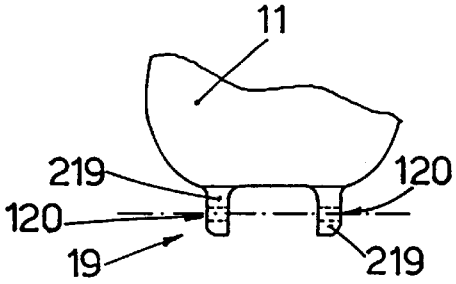
Figure 6:
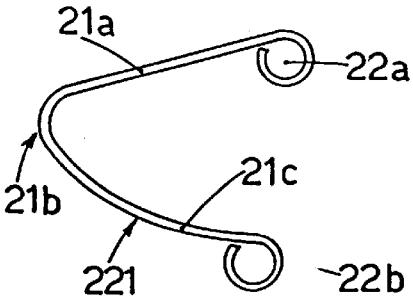
Figure 7:
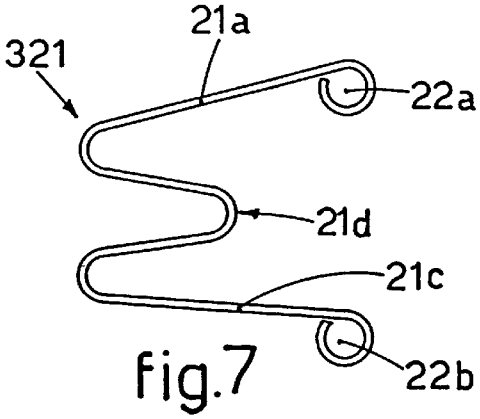
Figure 8:
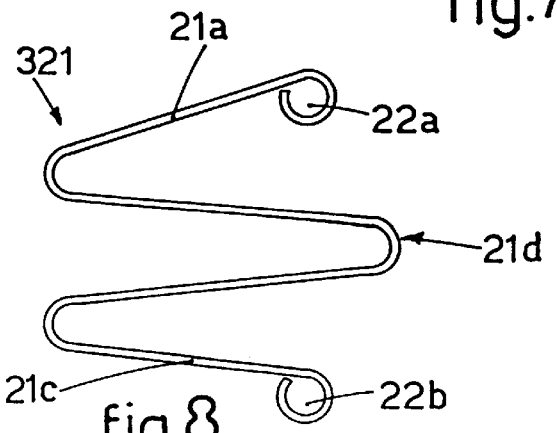

FIG. 5*b* shows the variant of FIG. 5*a* with a rear view of the skate shown in FIG. 1;

FIG. 6 shows a possible variant of FIG. 2 in diagram form;

FIGS. 7 and 8 show further variants of the embodiment shown in FIG. 2 in diagram form.

The skate 10 of the type with aligned wheels shown in FIG. 1 comprises a shoe 11 associated with a support 12 onto which are mounted the skating elements 13, in this case three wheels, respectively front 13*a*, middle 13*b* and rear 13*c*.

The invention is also applied however to skates with four wheels or more.

Between the shoe 11 and the support 12 there is a connection 14 of the articulated type, in this case, made at the front part of the shoe 11.

The articulated connection 14 is achieved by including, at the bottom part of the shoe 11, two extensions 15, each of which includes its own through hole 16 with an axis substantially horizontal and aligned with a through hole 17 made on the upper front part of the support 12.

The articulated constraint of the shoe 11 and the support 12 is obtained by inserting a pin 118 inside the holes 16 and 17.

At the lower part of the rear portion of the shoe 11, the skate 10 includes an extension 19 which constitutes a second constraint point between the shoe 11 and the support 12.

The extension 19 includes a through hole 20 with a substantially horizontal axis, to which one end of an elastic foil 21 is associated.

In this case, the elastic foil 21 is folded back into an acute angle and defines an inverted angle which connects an upper portion 21*a* to a lower portion 21*c* by means of a curved portion 21*b*.

The upper portion 21*a* and the lower portion 21*c* include, at their ends, an upper cylindrical seating 22*a* and a lower cylindrical seating 22*b* to house the relative pin-type connection means 18.

These cylindrical seatings 22*a* and 22*b* may include inside a bush on which the pin-type connection means 18 are mounted, applied for example by welding, brazing or another system.

The pin-type connection means 18 are respectively inserted inside the through hole 20 and the upper cylindrical seating 22*a* so as to attach the elastic foil 21 to the shoe 11, and inside a through hole 23 and the lower cylindrical seating 22*b* to attach the elastic foil 21 to the support 12.

In this way, the elastic foil 21 can easily be removed from the skate 10 by following a simple and rapid procedure.

It is thus possible to substitute the elastic foil 21 with other foils which have other characteristics, such as elasticity, load, amplitude of the angle of inversion etc.; it also makes it possible to-vary the pre-load of the elastic foil 21 by attaching the lower cylindrical seating 22*b* to a different through hole 23*a* which is included on the support 12.

The variation in the pre-load of the elastic foil 21 and/or its replacement by other foils with different characteristics makes it possible to vary the angle β of inclination of the sole of the shoe 11 with respect to the support 12; in this way it is possible to modify and personalize the arrangement of the skate 10.

According to the embodiment shown in FIGS. 1, 4*a* and 4*b*, the extension 19 consists of a central protrusion 119 defining, with the sole of the shoe 11, a slot 24; the elastic foil 21 is of the type shown in FIG. 2.

In correspondence with the upper cylindrical seating 22*a*, the elastic foil 21 includes a hollow 25 mating in width with the central protrusion 119 and of a depth to contain in the slot 24 a desired part of the first upper portion 21*a* adjacent to the hollow 25.

At the sides of the hollow 25 there are two eyelets 122 into which the pin-type connection means 18 are inserted.

In this embodiment, the upper portion 21*a* is kept in continuous contact with the sole of the shoe 11 and thus forms for the latter a resting surface which is large enough to show harmful load points which, in the long term, could damage the sole of the shoe 11.

The second lower portion 21*c*, connected to the first upper portion 21*a* by means of the curved portion 21*b* which defines the inverted angle, includes at the side a narrower part 26 so that it can adapt to the inner width of the support 12 and allow the elastic foil 21 to oscillate inside the support 12 without any interference.

Figure 3:
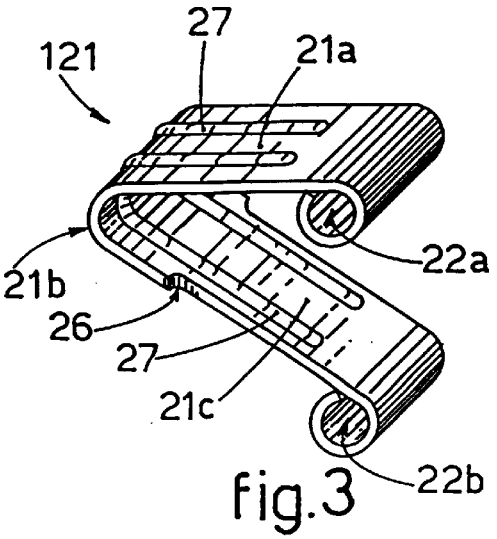
FIG. 3 shows a variant of FIG. 2.

In the variant shown in FIG. 3, the elastic foil 121 includes two reinforcing longitudinal ribs 27.

In the variant shown in FIGS. 5*a* and 5*b*, the lower extension 19 of the shoe 11 comprises two lateral protrusions 219 each of which includes its own through hole 120 with a substantially horizontal axis, and the elastic foil used is of the type shown in FIG. 3.

In this embodiment, the two protrusions 219 constitute two lateral constraining elements to the upper portion 22*a* while the upper cylindrical seating 22*a* is aligned with the through holes 120 so as to allow the pin means 18 to be inserted and thus associate the shoe 11 with the foil 121.

In the embodiments shown in FIGS. 2 and 3, the elastic foil 21, 121 includes the respective upper portion 21*a* and lower portion 21*c* substantially straight.

FIGS. 6, 7 and 8 show different variants to embody the elastic foil.

In FIG. 6, the elastic foil 221 has the upper portion 21*a* substantially straight and the lower portion 21*c* arched so as to increase its ability to bend.

In an embodiment which is not shown here, the elastic foil may also, or only, have its upper portion 21*a* arched.

In the embodiment shown in FIGS. 7 and 8, the upper portion 21*a* cooperating wiith the shoe 11 is connected to the lower portion 21*c* which cooperates with the support 12 by an intermediate portion 21*d* so that the elastic foil 321 defines three inversion angles. In FIG. 7, the intermediate portion 21*d* is shorter than the upper portion 21*a* and the lower portion 21*c*, while in FIG. 8 the intermediate portion 21*d* is longer than the other portions 21*a* and 21*c*.

I claim:

1. A shock absorber device for roller skates with wheels (13), wherein each roller skate includes a shoe (11) for lodging a foot and part of a user's leg, a support (12) for rotatably supporting the wheels (13), and articulation means (14) for articulating the shoe (11) with respect to the support (12), the shock absorber device comprising an elastic foil element (21, 121, 221, 321) having at least an upper portion (21*a*) and a lower portion (21*c*) defining at least one inverted angle therebetween, the upper portion (21*a*) being pivotally connected to the shoe (11) and the lower portion (21*c*) being pivotally connected to the support (12) at a distant point from the articulation means (14).

2. The device of claim 1 wherein the upper portion (21*a*) is substantially horizontal and defines a supporting surface for a sole of the shoe (11).

3. The device of claim 1 wherein the elastic foil (321) further includes an intermediate portion (21*d*) connected to the upper portion (21*a*) and the lower portion (21*c*) by means of two respective inverted angles.

4. The device of claim 1 wherein the upper portion (21*a*) and the lower portion (21*c*) are substantially straight.

5. The device of claim 1 wherein the upper portion (21*a*) and the lower portion (21*c*) are bow-shaped.

6. The device of claim 1 wherein at the ends of the upper portion (21*a*) and/or the lower portion (21*c*) there are respective seatings (22*a*, 22*b*) in which are inserted pin-type connection means (18) to attach respectively the shoe (11) and the support (12).

7. The device of claim 6 wherein the seatings include eyelets and in which an upper seating (22*a*) cooperates with at least one through hole (20, 120) included on an extension (19) of the sole of the shoe (11) and a lower seating (22*b*) cooperates with at least one through hole (23, 23*a*) on the support (12).

8. The device of claim 1 wherein the elastic foil (21, 121, 221, 321) is replaceably connected.

9. The device of claim 1 wherein the position at which the elastic foil (21, 121, 221, 321) is mounted is variable, at least with respect to the support (12).

10. The device of claim 6 wherein the upper seating (22*a*) and/or the lower seating (22*b*) cover substantially the whole extension of the pin-type connection means (18).

11. The device of claim 1 wherein the upper seating (22*a*) and/or the lower seating (22*b*) include two eyelets (122) separated by a hollow (25).

12. The device of claim 1 wherein the elastic foil (21, 121, 221, 321) is made of metal.

13. The device of claim 1 wherein the elastic foil (21, 121, 221, 321) is made of a non-metallic material.

14. The device of claim 1 wherein the elastic foil (21, 121, 221, 321) is made of mixed materials.

15. The device of claim 1 wherein the elastic foil (21, 121, 221, 321) includes lengthwise at least a reinforcing rib (27).

* * * * *